US011564859B2

(12) United States Patent
Lee

(10) Patent No.: US 11,564,859 B2
(45) Date of Patent: Jan. 31, 2023

(54) SHORTS-TYPE AIR PRESSURE MASSAGER

(71) Applicants: MAXSTAR INDUSTRIAL CO., LTD., Gimpo-Si (KR); Beom Joon Lee, Sokcho-Si (KR)

(72) Inventor: Beom Joon Lee, Sokcho-Si (KR)

( * ) Notice: Subject to any disclaimer, the term of this patent is extended or adjusted under 35 U.S.C. 154(b) by 92 days.

(21) Appl. No.: 16/755,748

(22) PCT Filed: May 15, 2018

(86) PCT No.: PCT/KR2018/005547

§ 371 (c)(1),
(2) Date: Apr. 13, 2020

(87) PCT Pub. No.: WO2019/103260

PCT Pub. Date: May 31, 2019

(65) Prior Publication Data

US 2020/0323732 A1 Oct. 15, 2020

Related U.S. Application Data

(60) Provisional application No. 62/589,139, filed on Nov. 21, 2017.

(51) Int. Cl.
*A61H 9/00* (2006.01)

(52) U.S. Cl.
CPC ..... *A61H 9/0092* (2013.01); *A61H 9/005* (2013.01); *A61H 9/0078* (2013.01);
(Continued)

(58) Field of Classification Search
CPC ..... A61H 9/0092; A61H 2201/165; A61H 2205/085; A61H 2205/108;
(Continued)

(56) References Cited

U.S. PATENT DOCUMENTS 3,071,133 A * 1/1963 Eisen ..... A41C 1/08 602/13
4,590,925 A * 5/1986 Dillon ..... A61H 9/0078 601/152

(Continued)

FOREIGN PATENT DOCUMENTS

JP 2003-079688 A 3/2003
JP 4059956 B2 3/2008

(Continued)

*Primary Examiner* — Rachel T Sippel
*Assistant Examiner* — Benjamin M. Kusiak
(74) *Attorney, Agent, or Firm* — Novick, Kim & Lee PLLC; Jae Youn Kim

(57) ABSTRACT

A shorts-type pneumatic massage apparatus includes a shorts-pressurizing portion including a left shorts portion, which includes a plurality of air chambers extending in a longitudinal direction of the wearer's legs and which has a right side open from a top of a crotch, and a right shorts portion, which includes a plurality of longitudinal air chambers extending in the longitudinal direction of the wearer's legs and has a left side open from the top of the crotch, wherein the open right side of the left shorts portion and the open left side of the right shorts portion are coupled along an end; and an air injection adjustment portion configured to inject air to or discharge air from each of the longitudinal air chambers to allow the longitudinal air chambers to expand or contract.

5 Claims, 10 Drawing Sheets

(52) U.S. Cl.
CPC ..... *A61H 2201/0103* (2013.01); *A61H 2201/0107* (2013.01); *A61H 2201/0157* (2013.01); *A61H 2201/1238* (2013.01); *A61H 2201/1409* (2013.01); *A61H 2201/164* (2013.01); *A61H 2201/165* (2013.01); *A61H 2201/1628* (2013.01); *A61H 2201/1645* (2013.01); *A61H 2201/50* (2013.01); *A61H 2201/5007* (2013.01); *A61H 2201/5056* (2013.01); *A61H 2205/085* (2013.01); *A61H 2205/088* (2013.01); *A61H 2205/10* (2013.01); *A61H 2205/108* (2013.01)

(58) Field of Classification Search
CPC ..... A61H 2201/164; A61H 2201/1628; A61H 2201/0103; A61H 2201/1238; A61H 2205/086; A61H 1/00; A61H 9/00; A61H 9/005; A61H 9/0078; A61H 2201/0107; A61H 2201/0157; A61H 2201/1409; A61H 2201/1645; A61H 2201/5007; A61H 2201/5056; A61H 2201/50; A61H 2205/088; A61H 2205/10; A41D 7/003; A41D 7/001; A41D 7/00; A41D 1/00; A41D 1/04; A41D 1/89
USPC ..... 601/151; 2/DIG. 3, 228, 238
See application file for complete search history.

(56) References Cited

U.S. PATENT DOCUMENTS 4,959,047 A * 9/1990 Tripp, Jr. ..... B64D 10/00 128/202.12
5,040,525 A * 8/1991 Georgijevic ..... A61F 5/0193 602/23
5,342,285 A * 8/1994 Dye ..... A61H 9/0078 137/602
5,706,523 A * 1/1998 Witzel ..... A41D 13/0506 2/227
5,918,310 A * 7/1999 Farahany ..... A41D 13/015 2/23
2002/0062515 A1* 5/2002 Wang ..... A41D 1/06 2/227
2004/0183283 A1* 9/2004 Buckman ..... A41D 13/018 280/730.1
2005/0067816 A1* 3/2005 Buckman ..... A61B 5/6805 280/730.1
2006/0064800 A1* 3/2006 Freund ..... A61F 13/069 2/446
2007/0255187 A1* 11/2007 Branch ..... A61H 7/001 601/15
2008/0243041 A1* 10/2008 Brenner ..... A61H 7/004 601/151
2011/0087142 A1* 4/2011 Ravikumar ..... A61F 13/069 601/151
2011/0167537 A1* 7/2011 Christoff ..... A41D 1/065 2/228
2012/0023643 A1* 2/2012 O'Connell ..... A41D 1/089 2/228
2013/0331747 A1* 12/2013 Helgeson ..... A61H 23/04 601/48
2017/0128306 A1* 5/2017 Chase ..... A61F 13/062
2017/0318991 A1* 11/2017 Loftus ..... A47C 7/467
2018/0071129 A1* 3/2018 Ozsecen ..... A61F 5/028
2019/0133215 A1* 5/2019 Whalen ..... A63B 21/4011
2019/0380905 A1* 12/2019 Sekula ..... A61H 9/0078

FOREIGN PATENT DOCUMENTS

KR 200272378 Y1 * 4/2002
KR 10-2009-0114111 A 11/2009
KR 20-2011-0000107 U 1/2011
KR 200472269 Y1 * 4/2014
KR 20-2014-0002788 U 5/2014
KR 10-2015-0031538 A 3/2015
KR 10-1527675 B1 6/2015
KR 10-1778983 B1 9/2017
KR 10-1778984 B1 9/2017

* cited by examiner

SHORTS-TYPE AIR PRESSURE MASSAGER

CROSS-REFERENCE TO RELATED APPLICATION

This application claims priority to and the benefit of PCT Application No. PCT/KR2018/005547, filed on May 15, 2018, which claims priority to U.S. provisional application 62/589,139, filed Nov. 21, 2017, the disclosure of which is incorporated herein by reference in its entirety.

BACKGROUND

1. Field of the Invention

The present invention relates to a shorts-type pneumatic massage apparatus, and more particularly, to a shorts-type pneumatic massage apparatus capable of evenly applying a pneumatic massage to thigh muscles and simultaneously applying an appropriate pneumatic massage to a pelvis region.

2. Discussion of Related Art

Massage is a treatment for curing a disorder and enhancing health by remedying an irregularity of a body through stimulation of pressurizing or touching the skin or muscles with hands that has been generally known from ancient times.

Recently, many air pressure massage apparatuses which are put on a human body and stimulate the body through injection or discharge of air have been developed which promote blood circulation and activate metabolism by repetitively pressurizing and relaxing the body through pneumatic changes so as to restore, maintain, and increase human health.

As a related art, there is known a four-limb pneumatic massage apparatus which is put on human legs and pressurizes or relaxes, through air pressure, parts such as thighs, calves, ankles, and the like. Here, although the four-limbs pneumatic massage apparatus is put on thighs, upper positions of thighs are open, and thus a pressure caused by air injection is not evenly transferred to thighs. Accordingly, there is a disadvantage that adequate massage is not performed on a person who uses his or her thighs a great deal such as an athlete.

Also, an air tube through which air is injected is disposed laterally to a longitudinal direction of legs so that pressurization is cut off between tubes when the pressurization caused by air injection is performed. Here, when muscles are formed longitudinally lengthwise like thigh muscles, there is a disadvantage that muscles formed longitudinally lengthwise are not evenly pressurized.

SUMMARY OF THE INVENTION

The present invention is directed to providing a shorts-type pneumatic massage apparatus formed in a shorts shape so that a pressurizing portion surrounds overall thighs and including an air chamber into which air is injected and which is formed longitudinally lengthwise in a longitudinal direction of legs so as to evenly apply a pneumatic massage to thigh muscles and to simultaneously apply an appropriate pneumatic massage to a pelvis region.

The present invention is also directed to providing a shorts-type pneumatic massage apparatus capable of easily forming a shorts-type massage apparatus to form a shorts-type massage apparatus by coupling a left shorts portion and a right shorts portion.

According to an aspect of the present invention, there is provided a shorts-type pneumatic massage apparatus including a shorts-pressurizing portion including a left shorts portion, which includes a plurality of air chambers having side ends connected to surround a left thigh of a wearer and extending in a longitudinal direction of a wearer's legs and which has a right side open from a top of a crotch, and a right shorts portion, which includes a plurality of longitudinal air chambers having side ends connected to surround a right thigh of the wearer and extending in the longitudinal direction of the wearer's legs and which has a left side open from the top of the crotch, wherein the open right side of the left shorts portion and the open left side of the right shorts portion are coupled along an end and an air injection adjustment portion configured to inject air to or discharge air from each of the longitudinal air chambers to allow the longitudinal air chambers to expand or contract.

The shorts-pressurizing portion may further include suspenders put on shoulders of the wearer to fix the shorts-pressurizing portion so as not to slip down.

The longitudinal air chambers of the left shorts portion may include a plurality of left longitudinal air chambers sequentially developed as side ends thereof are connected to each other, and ends of the left longitudinal air chambers among the plurality of developed left longitudinal air chambers, which are located outermost, may be fastened to or separated from each other. Also, the longitudinal air chambers of the right shorts portion may include a plurality of right longitudinal air chambers sequentially developed as side ends thereof are connected to each other, and ends of the right longitudinal air chambers among the plurality of developed right longitudinal air chambers, which are located outermost, may be fastened to or separated from each other.

The left longitudinal air chambers of the left shorts portion may be formed by sequentially developing a first left longitudinal air chamber and a second left longitudinal air chamber disposed in front of the wearer and a third left longitudinal air chamber and a fourth left longitudinal air chamber disposed to the rear of the wearer. Also, the right longitudinal air chambers of the right shorts portion may be formed by sequentially developing a first right longitudinal air chamber and a second right longitudinal air chamber in front of the wearer and a third right longitudinal air chamber and a fourth right longitudinal air chamber disposed to the rear of the wearer.

A zipper may be formed along a side end of the first left longitudinal air chamber and a side end of the fourth left longitudinal air chamber so that the left shorts portion may be developed by opening the zipper. Also, a zipper may be formed along a side end of the first right longitudinal air chamber and a side end of the fourth right longitudinal air chamber so that the right shorts portion may be developed by opening the zipper.

A zipper may be formed along the open right end of the left shorts portion and the open left end of the right shorts portion so that the left shorts portion and the right shorts portion may be coupled or separated by the zipper.

The left shorts portion may include a left lateral air chamber which communicates with the third left longitudinal air chamber or the fourth left longitudinal air chamber disposed to the rear of the wearer and extends laterally corresponding to a left waist region of the wearer. Also, the right shorts portion may include a right lateral air chamber which communicates with the third right longitudinal air chamber or the fourth right longitudinal air chamber disposed to the rear of the wearer and extends laterally corresponding to a right waist region of the wearer.

The air injection adjustment portion may include a plurality of air lines connected to the longitudinal air chambers and an air injection unit connected to the plurality of air lines and configured to inject air into or discharge air from the longitudinal air chambers.

The air injection adjustment portion may include a left air line set for a left side and a right air line set for a right side, which include a plurality of air lines having side ends coupled with each other in a longitudinal direction. Here, some of the air lines of the left air line set may be coupled with the left longitudinal air chambers among the plurality of left longitudinal air cambers, which are located in front, and others thereof may be coupled with the left longitudinal air chambers among the plurality of left longitudinal air chambers, which are located to the rear, via a bottom of the crotch. Also, some of the air lines of the right air line set may be coupled with the right longitudinal air chambers among the plurality of right longitudinal air chambers, which are located in front, and others thereof may be coupled with the right longitudinal air chambers among the plurality of right longitudinal air chambers, which are located to the rear, via the bottom of the crotch.

The air injection adjustment portion may include a left air line set for a left side and a right air line set for a right side, which include four air lines having side ends that are coupled with each other in a longitudinal direction. Here, the left air line set may be introduced into the second left longitudinal air chamber so that two of the air lines may be coupled with the first left longitudinal air chamber and the second left longitudinal air chamber and two others of the air lines may be coupled with the third left longitudinal air chamber and the fourth left longitudinal air chamber via a bottom of the crotch. Also, the right air line set may be introduced into the second right longitudinal air chamber so that two of the air lines may be coupled with the first right longitudinal air chamber and the second right longitudinal air chamber and two others of the air lines may be coupled with the third right longitudinal air chamber and the fourth right longitudinal air chamber via the bottom of the crotch.

The shorts-pressurizing portion may further include an air line cover configured to cover the left air line set and the right air line set so as not to expose the left air line set and the right air line set from the shorts-pressurizing portion.

The air injection adjustment portion may further include an air injection unit configured to inject air into or discharge air from the longitudinal air chambers and a main air line set having one end connected to the air injection unit. Here, the other end of the main air line set may diverge into two and be connected to the left air line set and the right air line set.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
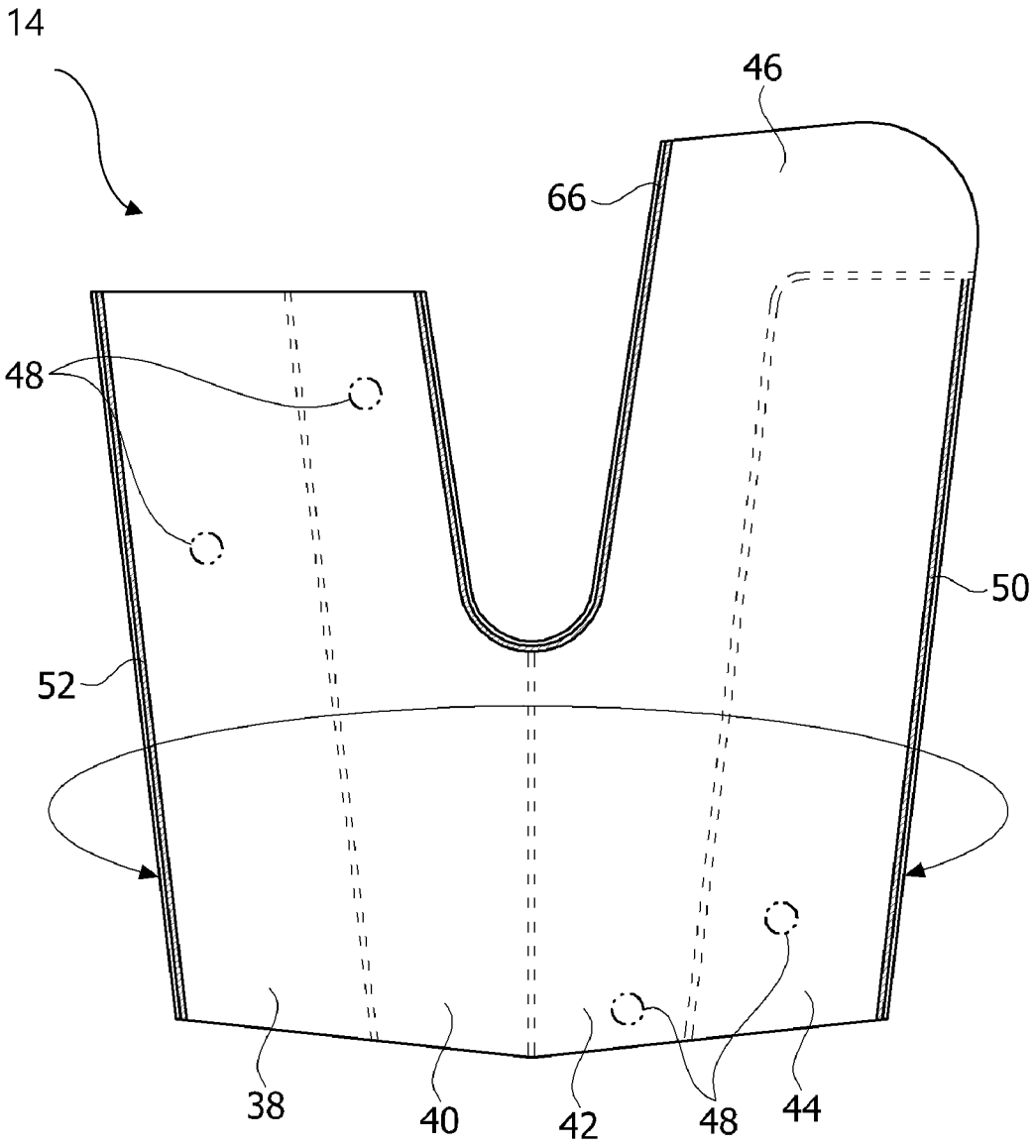
FIG. 1 is a developed view illustrating a left shorts portion of a shorts-type pneumatic massage portion according to one embodiment of the present invention.

Since the present invention may be variously modified and have a variety of embodiments, particular embodiments will be illustrated in the drawings and described in detail hereinafter. However, these are not intended to limit the present invention to a particularly disclosed form and it should be understood that the present invention includes all changes, equivalents, and substitutes included within the concept and technical scope of the present invention. In a description of the embodiments of the present invention, a detailed description of well-known components or functions of the related art will be omitted when it is deemed to obscure understanding of the embodiments of the present invention.

Hereinafter, a shorts-type pneumatic massage apparatus according to the present invention will be described in detail with reference to the attached drawings. In a description with reference to the attached drawings, like or corresponding elements will be referred to as like reference numerals and a repetitive description thereof will be omitted.

Figure 2:
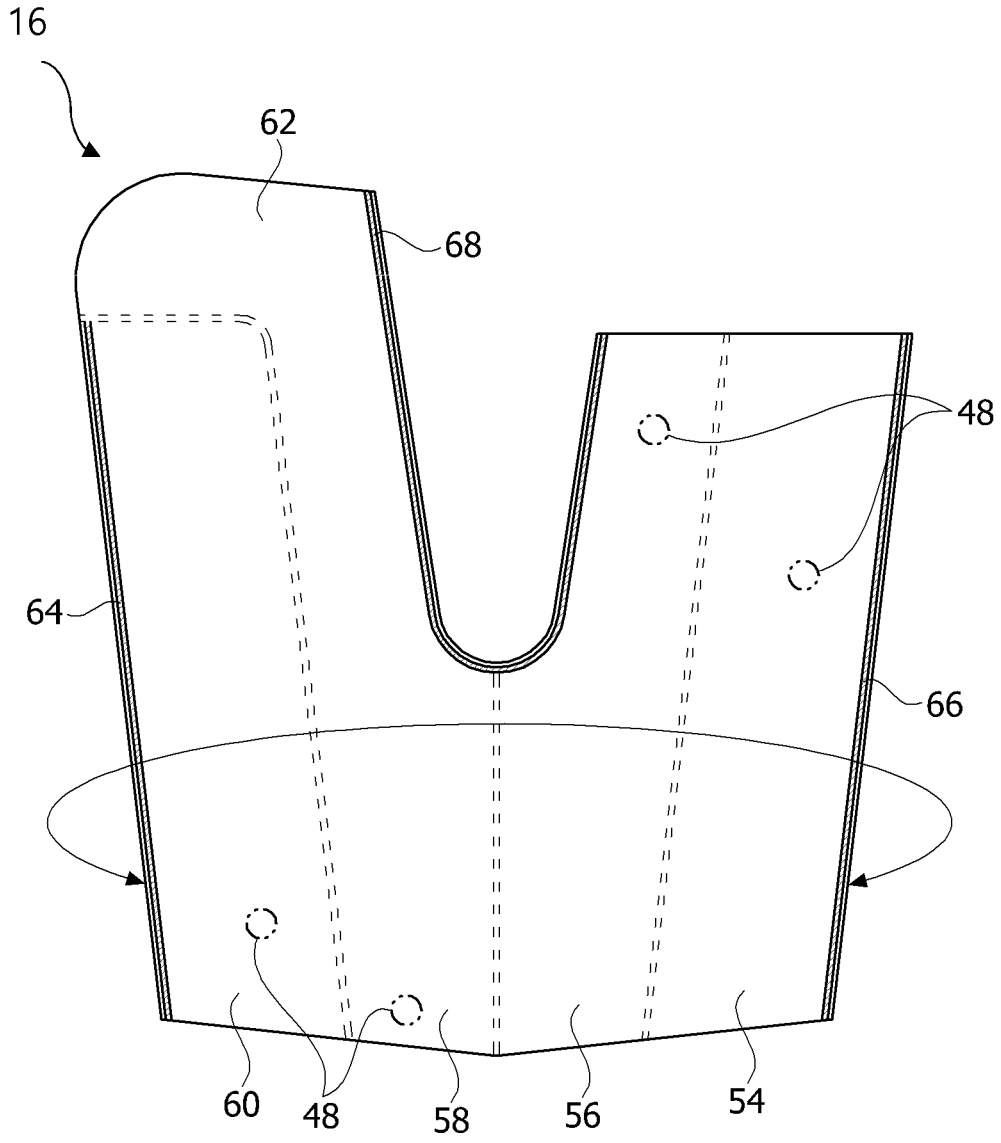
FIG. 2 is a developed view illustrating a right shorts portion of the shorts-type pneumatic massage portion according to one embodiment of the present invention.
Figure 3:
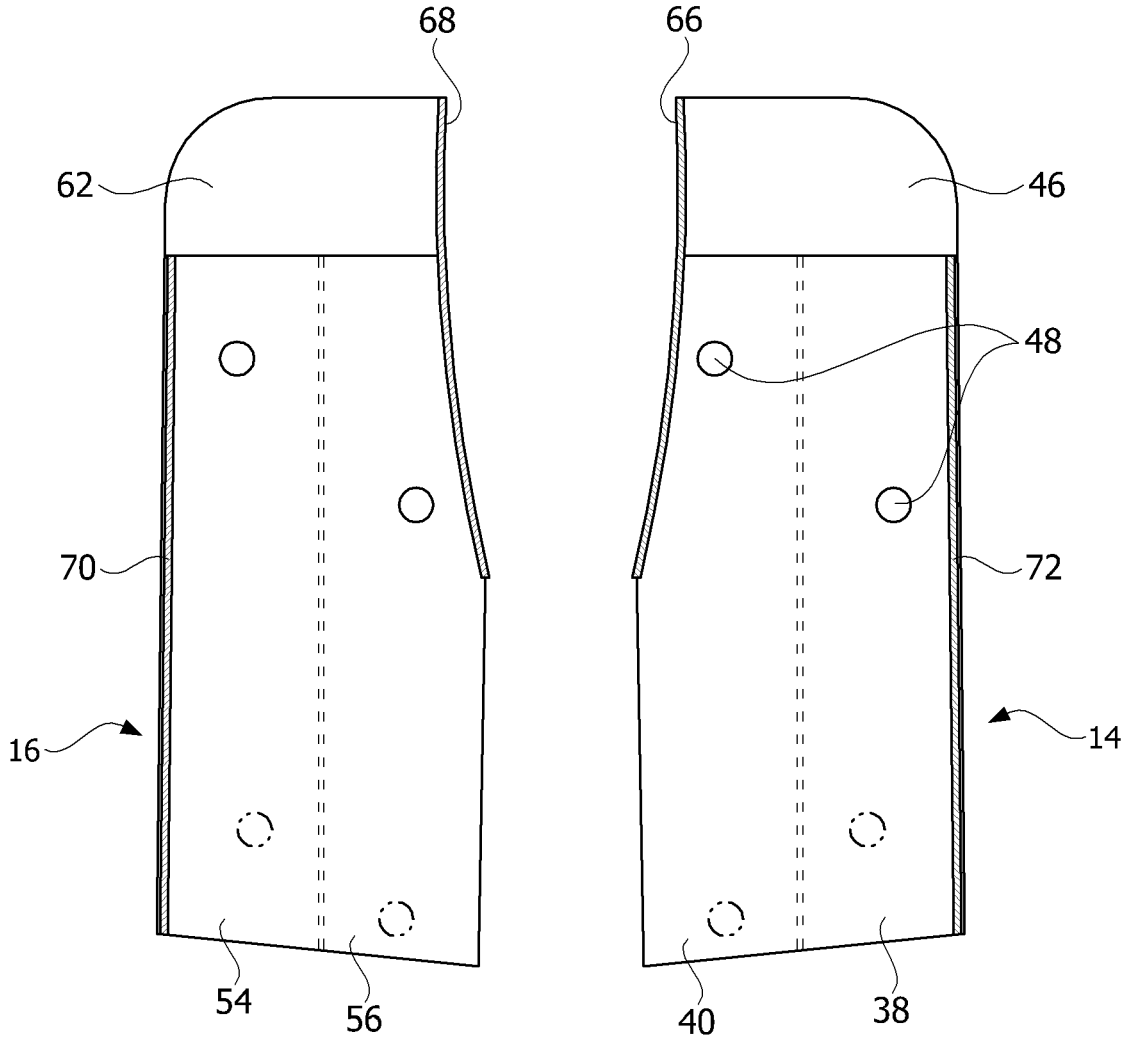
FIGS. 3 and 4 are views illustrating a coupling state of the left and right shorts portions of the shorts-type pneumatic massage apparatus according to one embodiment of the present invention.
Figure 4:
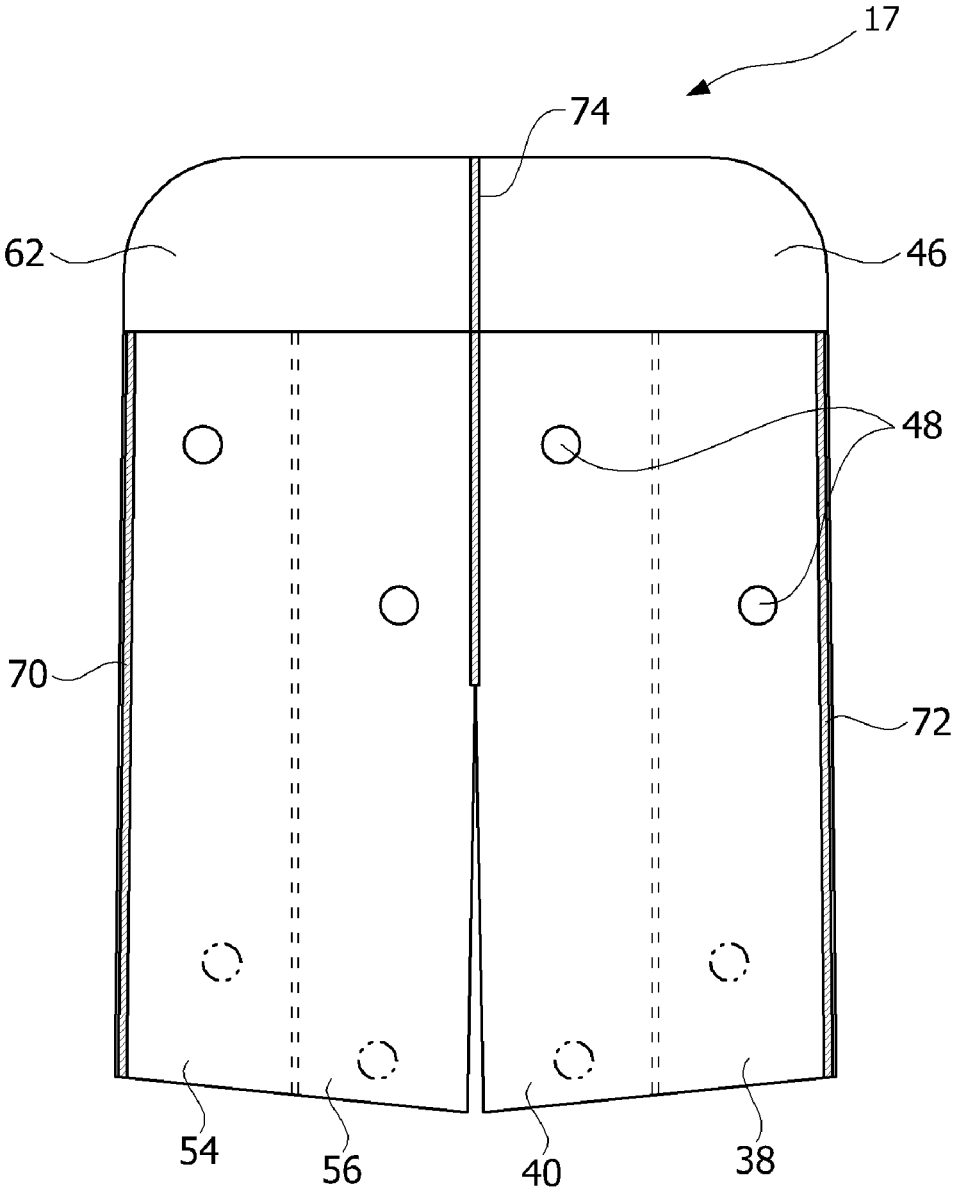
Figure 5:
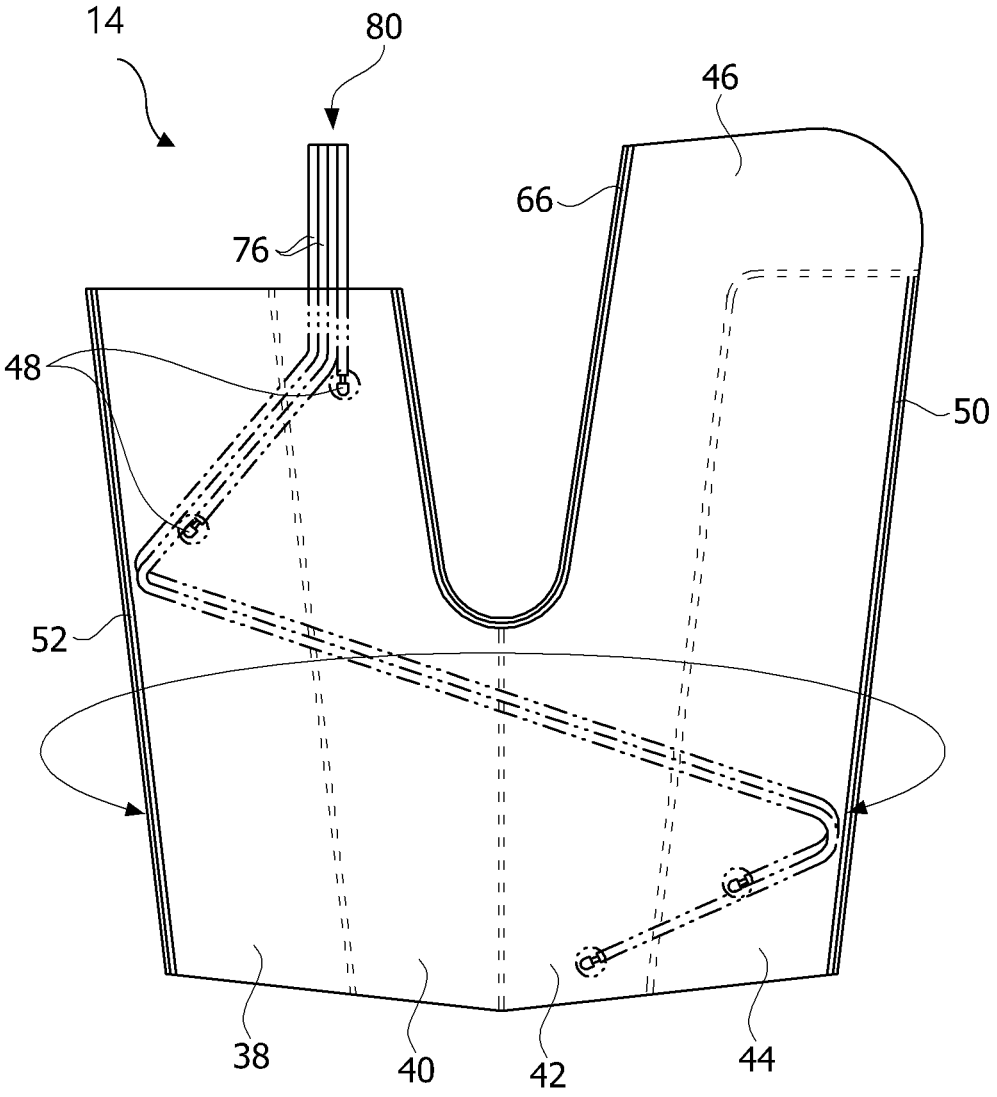
FIG. 5 is an air line arrangement plan of the left shorts portion of the shorts-type pneumatic massage portion according to one embodiment of the present invention.
Figure 6:
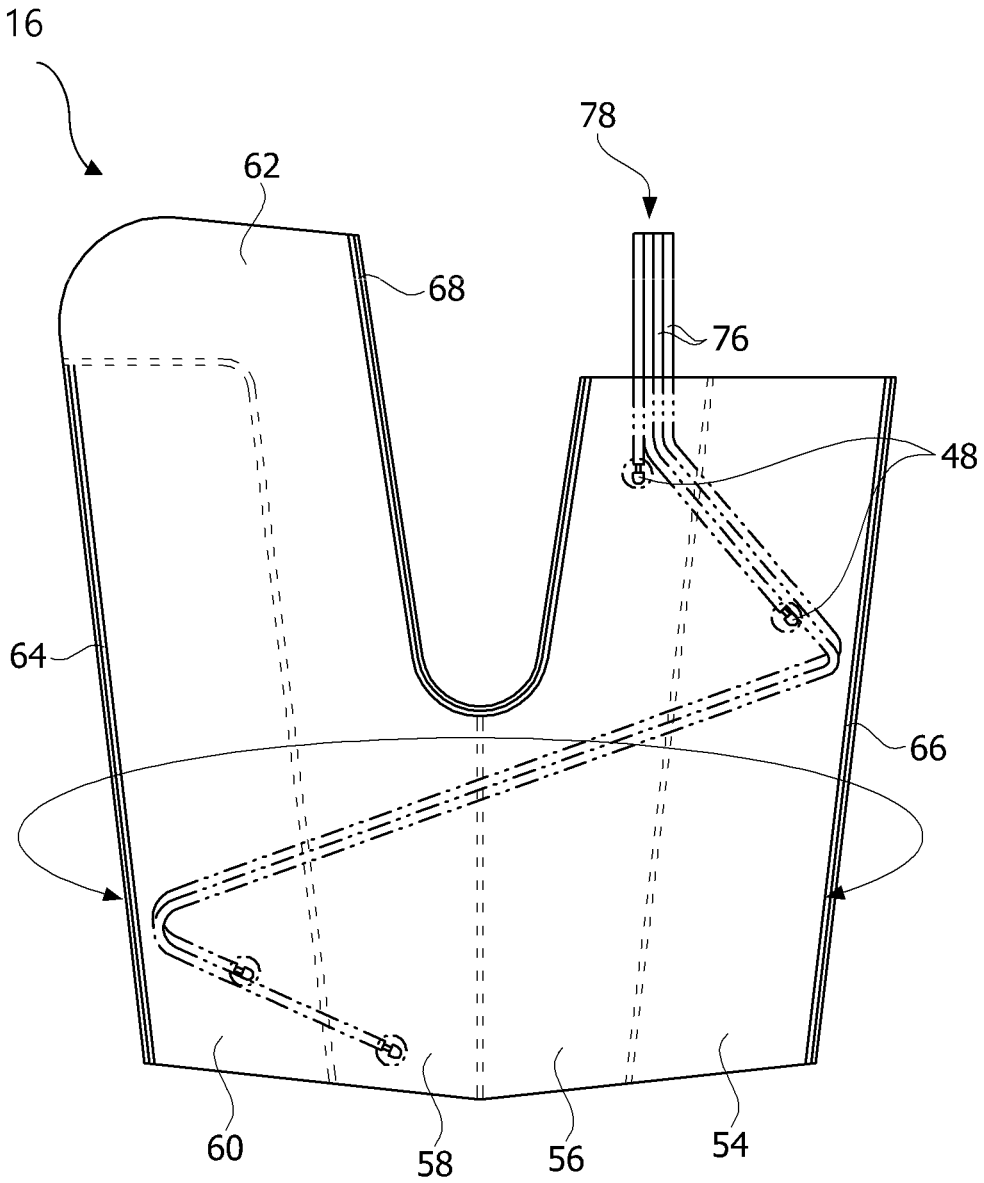
FIG. 6 is an air line arrangement plan of the right shorts portion of the shorts-type pneumatic massage portion according to one embodiment of the present invention.
Figure 7:
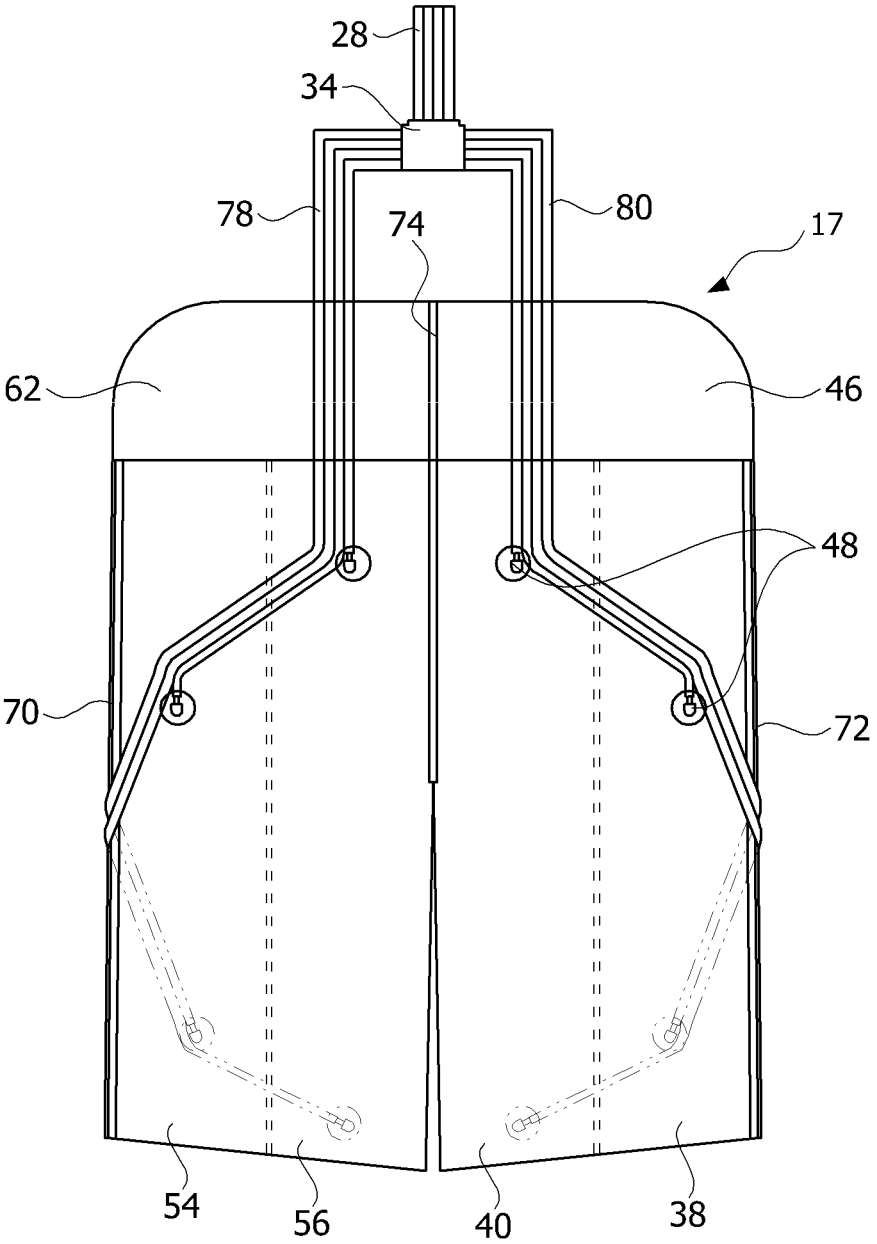
FIG. 7 is an air line arrangement plan of the shorts-type pneumatic massage portion according to one embodiment of the present invention.

FIG. 1 is a developed view illustrating a left shorts portion of a shorts-type pneumatic massage portion according to one embodiment of the present invention, FIG. 2 is a developed view illustrating a right shorts portion of the shorts-type pneumatic massage portion according to one embodiment of the present invention, and FIGS. 3 and 4 are views illustrating a coupling state of the left and right shorts portions of the shorts-type pneumatic massage apparatus according to one embodiment of the present invention. Also, FIG. 5 is an air line arrangement plan of the left shorts portion of the shorts-type pneumatic massage portion according to one embodiment of the present invention, FIG. 6 is an air line arrangement plan of the right shorts portion of the shorts-type pneumatic massage portion according to one embodiment of the present invention, and FIG. 7 is an air line arrangement plan of the shorts-type pneumatic massage portion according to one embodiment of the present invention.

Figure 8:
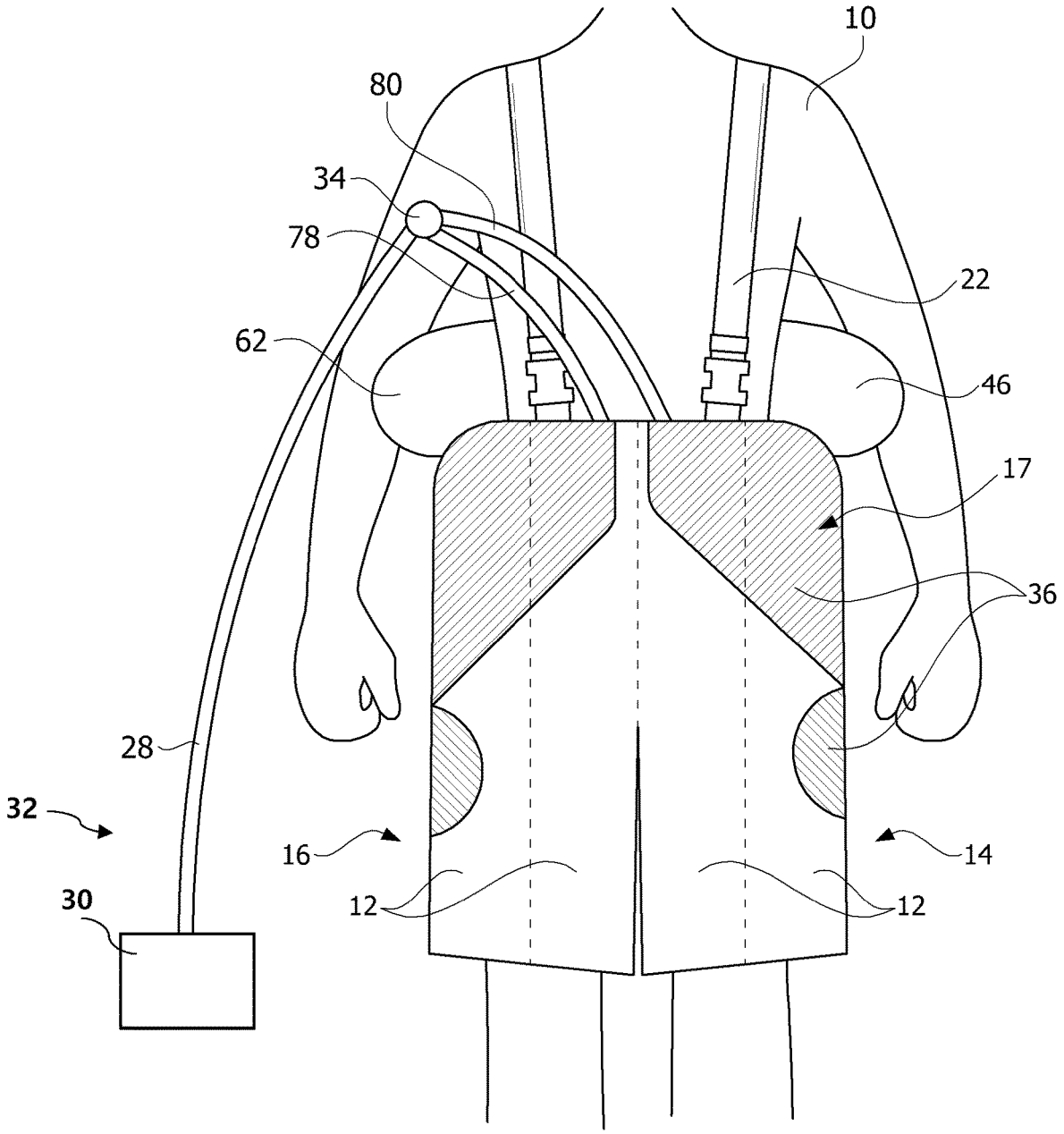
FIG. 8 is a front view illustrating a wearer of the shorts-type pneumatic massage portion according to one embodiment of the present invention.
Figure 9:
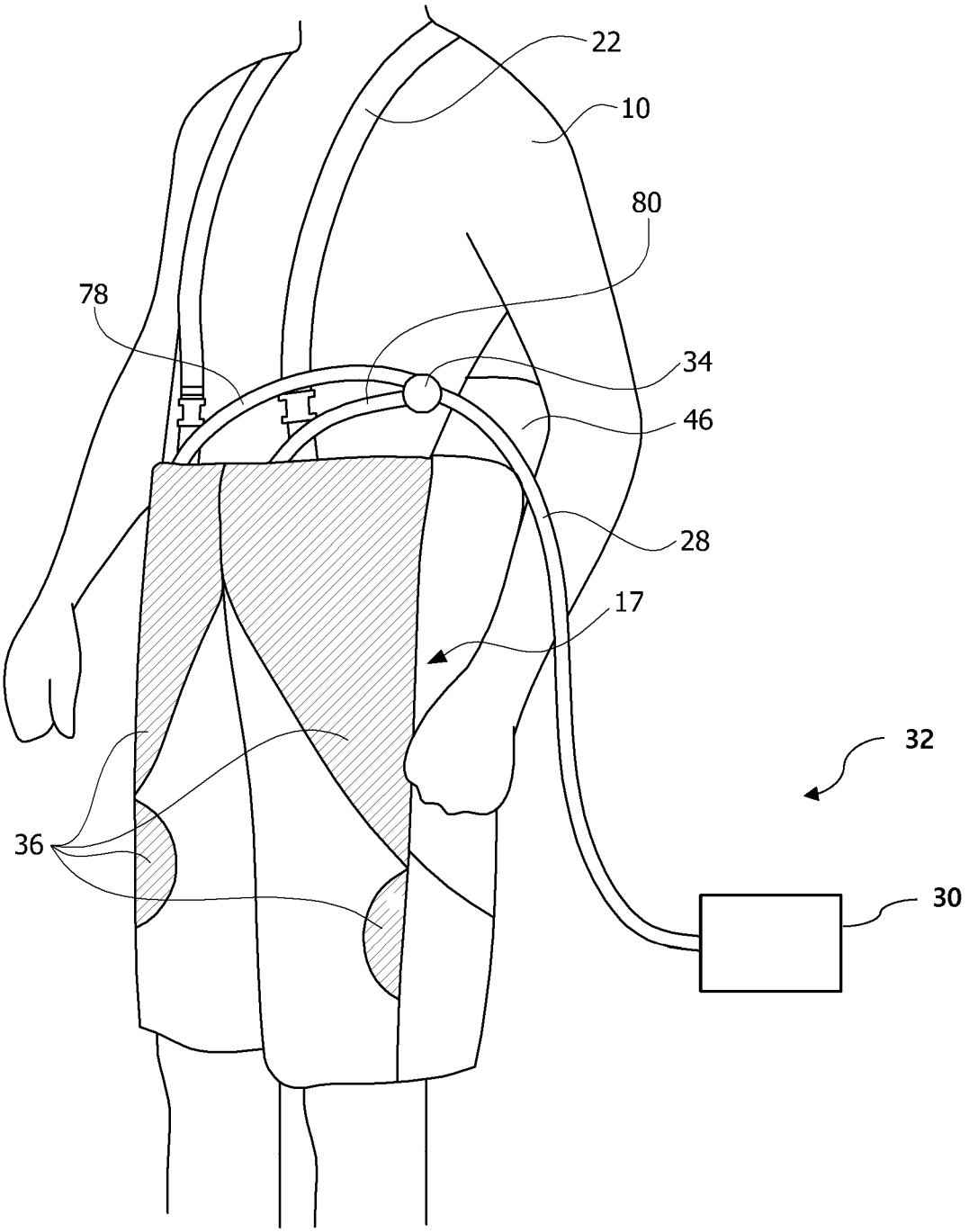
FIG. 9 is a side view illustrating the wearer of the shorts-type pneumatic massage portion according to one embodiment of the present invention.
Figure 10:
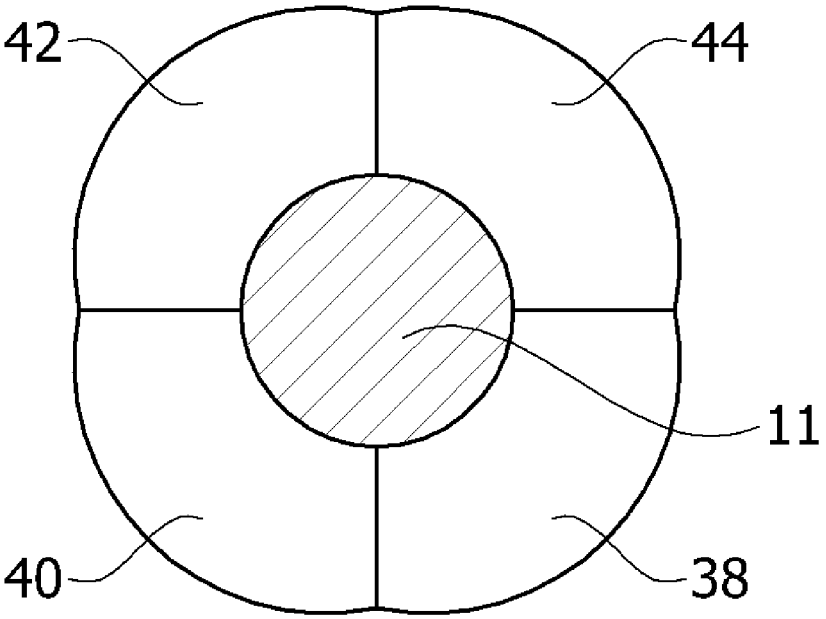
FIG. 10 is a view illustrating a state in which the shorts-type pneumatic massage apparatus according to one embodiment of the present invention pressurizes thighs.

Also, FIG. 8 is a front view illustrating a wearer 10 of the shorts-type pneumatic massage portion according to one embodiment of the present invention, FIG. 9 is a side view illustrating the wearer 10 of the shorts-type pneumatic massage portion according to one embodiment of the present invention, and FIG. 10 is a view illustrating a state in which the shorts-type pneumatic massage apparatus according to one embodiment of the present invention pressurizes thighs.

FIGS. 1 to 10 illustrate the wearer 10, thighs 11, a longitudinal air chamber 12, a left shorts portion 14, a right shorts portion 16, a shorts pressurizing portion 17, suspenders 22, a main air line set 28, an air injection unit 30, an air injection adjustment portion 32, a divergent hole 34, an air line cover 36, a first left longitudinal air chamber 38, a second left longitudinal air chamber 40, a third left longitudinal air chamber 42, a fourth left longitudinal air chamber 44, a left lateral air chamber 46, an air injection hole 48, zipper strips 50, 52, 64, 66, and 68, a first right longitudinal air chamber 54, a second right longitudinal air chamber 56, a third right longitudinal air chamber 58, a fourth right longitudinal air chamber 60, a right lateral air chamber 62, zippers 70, 72, and 74, an air line 76, a right air line set 78, and a left air line set 80.

The shorts-type pneumatic massage apparatus according to the embodiment includes the left shorts portion 14 which includes a plurality of longitudinal air chambers 12 having side ends connected to surround a left thigh 11 of the wearer 10 and extending in a longitudinal direction of the wearer's legs and has a right side open from a top of a crotch, the right shorts portion 16 which includes a plurality of longitudinal air chambers 12 having side ends connected to surround a right thigh 11 of the wearer 10 and extending in the longitudinal direction of the wearer's legs and has a left side open from the top of the crotch, the shorts-pressurizing portion 17 where the open right side of the left shorts portion 14 and the open left side of the right shorts portion 16 are coupled along an end, and the air injection adjustment portion 32 configured to inject air to or discharge air from each of the longitudinal air chambers 12 to allow the longitudinal air chambers 12 to expand or contract.

The shorts-pressurizing portion 17 according to the embodiment includes the left shorts portion 14 which is put on a left lower body of the wearer 10 and the right shorts portion 16 which is put on a right lower body of the wearer 10. The left shorts portion 14 and the right shorts portion 16 are coupled at the top of the crotch of the shorts-pressurizing portion 17 so as to form the shorts-pressurizing portion 17.

The left shorts portion 14, as shown in FIG. 3, includes the plurality of longitudinal air chambers 12, which has the side ends connected to surround the left thigh 11 of the wearer 10 and extends in the longitudinal direction of the wearer's legs, and is configured to have the right side open at the top of the crotch.

The left shorts portion 14 includes the plurality of longitudinal air chambers 12 having a barrel shape so that the left thigh 11 is inserted thereinto and surrounded thereby while the right side is open at the top of the shorts crotch. A rightward open part is connected to a leftward open part of the right shorts portion 16, which will be described below, so as to form a barrel shape into which a pelvis including buttocks are inserted.

The longitudinal air chamber 12 includes a tube formed lengthwise in the longitudinal direction of the legs and into which air is injectable and forms an air column which is lengthwise in a longitudinal direction as the air is injected into the tube. The side ends of the plurality of longitudinal air chambers 12 are connected to each other and disposed to surround the left thigh 11 while the side ends are separated and open toward the right side at the top of the crotch. FIG. 10 illustrates a state in which air is injected into the longitudinal air chamber 12 and pressurizes the left thigh 11.

A femoral region called the thighs 11 is located above knees below the pelvis, and the longitudinal air chambers 12 of the left shorts portion 14 are configured to pass the thigh 11 and extend to the waist from above the left knee. Accordingly, when the air is injected, the entirety of the thigh 11 above the knee may be longitudinally surrounded and a pneumatic massage may be evenly applied overall to the thigh 11 according to the air injection.

The right shorts portion 16, as shown in FIG. 3, includes the plurality of longitudinal air chambers 12, which has the side ends connected to surround the right thigh 11 of the wearer 10 and extends in the longitudinal direction of the wearer's legs, and is configured to have the left side open at the top of the crotch.

The right shorts portion 16 includes the plurality of longitudinal air chambers 12 having a barrel shape so that the right thigh 11 is inserted thereinto and surrounded thereby while the left side is open at the top of the shorts crotch. As shown in FIG. 6, the leftward open part is connected to the rightward open part of the left shorts portion 14 so as to form a barrel shape into which a lower abdomen is inserted.

The longitudinal air chambers 12 of the right shorts portion 16 may be formed to pass the right thigh 11 and extend to the waist from above the right knee, like the left shorts portion 14, and may longitudinally surround the entirety of the right thigh 11 above the knee according to air injection and evenly apply a pneumatic massage to overall muscles of the thigh 11.

The open right side of the left shorts portion 14 and the open left side of the right shorts portion 16 are coupled along ends so that the left shorts portion 14 and the right shorts portion 16 form the shorts-pressurizing portion 17.

While the wearer 10 inserts a left leg and a right leg into a left leg opening and a right leg opening of the shorts-pressurizing portion 17 to wear the shorts-pressurizing portion 17, a massage is performed by pressurizing or relaxing the left and right thighs 11 and the pelvis region of the wearer 10 by injecting air into or discharging air from each of the longitudinal air chambers 12 using the air injection adjustment portion 32 which will be described below.

Since the longitudinal air chambers 12 according to the embodiment pass the thighs of the wearer and extend to the waist region from the knees region, it is possible to apply an appropriate pneumatic massage not only to the thighs but also to the pelvis region by injecting or discharging air.

The air injection adjustment portion 32 injects air into or discharges air from each of the longitudinal air chambers 12 so that the longitudinal air chambers 12 expand or contract.

The air injection hole 48 through which air is injectable is formed in each of the plurality of longitudinal air chambers 12, and the longitudinal air chambers 12 are expanded or contracted by injecting or discharging the air through the air injection hole 48. The air line 76 is separately installed in each of the longitudinal air chambers 12 so that the longitudinal air chambers 12 may have different air injection amounts so as to massage the wearer 10 through a variety of programs.

Meanwhile, the shorts-pressurizing portion 17 may include the suspenders 22 put on shoulders of the wearer 10 to fix the shorts-pressurizing portion 17 so as not to slip down. In the case of the thighs 11 of a human, a thickness of the thighs 11 increases from the knees to below the pelvis. Here, since the longitudinal air chambers 12 are formed in the longitudinal direction of the legs, when the air is injected, the plurality of longitudinal air chambers 12 are arranged in a downward conic shape in which a plurality of air column bodies are formed so that the shorts-pressurizing portion 17 may slip down. Accordingly, the shorts-pressurizing portion 17 may be prevented, by fastening the suspenders 22, from slipping down when air is injected or discharged.

The shorts-type pneumatic massage apparatus according to the embodiment provides manufacturing convenience. The left shorts portion 14 and the right shorts portion 16 are separately manufactured and coupled with each other at the top of the crotch to form the shorts-pressurizing portion 17. As shown in FIGS. 1 and 2, the left shorts portion 14 and the right shorts portion 16 are manufactured as members developed in a plan shape and assembled so as to form the shorts-pressurizing portion 17.

First, in consideration of the left shorts portion 14, as shown in FIG. 1, the longitudinal air chambers 12 of the left shorts portion 14 include the plurality of left longitudinal air chambers 38, 40, 42, and 44 which have side ends are connected to each other and sequentially developed. Here, ends of the left longitudinal air chambers 38 and 44 among the plurality of developed left longitudinal air chambers 38, 40, 42, and 44, which are located outermost, are configured to be fastened to or separated from each other.

FIG. 1 illustrates a developed state of the left shorts portion 14. Here, in a direction from a left side to a right side of FIG. 1, the first left longitudinal air chamber 38, the second left longitudinal air chamber 40, the third left longitudinal air chamber 42, and the fourth left longitudinal air chamber 44 are sequentially developed as the side ends thereof are connected to one another. Here, although bottom ends of the second left longitudinal air chamber 40 and the third left longitudinal air chamber 42 are connected to each other, top ends thereof are not connected to each other and are separated. Here, the separated parts form an open right portion thereafter.

When the ends of the left longitudinal air chambers 38 and 44 located outermost are fastened to each other by rolling the plurality of left longitudinal air chambers 38, 40, 42, and 44 in a developed state, as shown in a right side of FIG. 3, the assembled left shorts portion 14 with the open portion on the right side thereof is formed.

Hereinafter, for convenience of description, "the developed left shorts portion 14" means a case in which the ends of the left longitudinal air chambers 38 and 44 located outermost are separated from each other so as to be developed, and "the assembled left shorts portion 14" means a case in which the ends of the left longitudinal air chambers 38 and 44 are coupled with each other so as to be assembled.

Referring to FIG. 1, when a left end of the first left longitudinal air chamber 38 and a right end of the fourth left longitudinal air chamber 44 are connected to each other by rolling the first to fourth left longitudinal air chambers 38, 40, 42, and 44 in the developed state, the assembled left shorts portion 14 including open parts formed in the left leg opening, into which the left thigh 11 is inserted, and an upper right side is formed. On the other hand, when the left end of the first left longitudinal air chamber 38 and the right end of the fourth left longitudinal air chamber 44 are separated from each other while the left shorts portion 14 is formed, the left shorts portion 14 returns to the developed state.

Also, in consideration of the right shorts portion 16, as shown in FIG. 2, the longitudinal air chambers 12 of the right shorts portion 16 include the plurality of right longitudinal air chambers 54, 56, 58, and 60 which have side ends that are connected to each other and sequentially developed. Here, ends of the right longitudinal air chambers 54 and 60 among the plurality of developed right longitudinal air chambers 54, 56, 58, and 60, which are located outermost, are configured to be fastened to or separated from each other.

Meanwhile, FIG. 2 illustrates a developed state of the right shorts portion 16. Here, in a direction from a right side to a left side of FIG. 2, the first right longitudinal air chamber 54, the second right longitudinal air chamber 56, the third right longitudinal air chamber 58, and the fourth right longitudinal air chamber 60 are sequentially developed as the side ends thereof are connected to one another. Here, although bottom ends of the second right longitudinal air chamber 56 and the third right longitudinal air chamber 58 are connected to each other, top ends thereof are not connected to each other and separated. Here, the separated parts form an open left portion thereafter.

Like the left shorts portion 14, when the ends of the right longitudinal air chambers 54 and 60 located outermost are fastened to each other by rolling the plurality of right longitudinal air chambers 54, 56, 58, and 60 in the developed state, as shown in a left side of FIG. 3, the right shorts portion 16 with the open portion on the left side thereof is formed.

Hereinafter, for convenience of description, like the left shorts portion 14, "the developed right shorts portion 16" means a case in which the ends of the right longitudinal air chambers 54 and 60 located outermost are separated from each other so as to be developed, and "the assembled right shorts portion 16" means a case in which the ends of the right longitudinal air chambers 54 and 60 located outermost are coupled with each other so as to be assembled.

Referring to FIG. 2, when a right end of the first right longitudinal air chamber 54 and a left end of the fourth right longitudinal air chamber 60 are connected to each other by rolling the first to fourth right longitudinal air chambers 54, 56, 58, and 60 in the developed state, the assembled right shorts portion 16 including open parts formed in the right leg opening, into which the right thigh 11 is inserted, and an upper left side is formed. On the other hand, when the right end of the first right longitudinal air chamber 54 and the left end of the fourth right longitudinal air chamber 60 are separated from each other while the right shorts portion 16 is formed, the right shorts portion 16 returns to the developed state.

When the open right side of the assembled left shorts portion 14 and the open left side of the assembled right shorts portion 16 are coupled along the ends while the left shorts portion 14 and the right shorts portion 16 are assembled, the shorts-pressurizing portion 17 is formed.

While the left shorts portion 14 is assembled, the first and second left longitudinal air chambers 38 and 40 of the assembled left shorts portion 14 are disposed in front of the left thigh 11 on the basis of the wearer 10, and the third and fourth left longitudinal air chambers 42 and 44 are disposed to the rear of the left thigh 11 on the basis of the wearer 10.

Likewise, while the right shorts portion 16 is assembled, the first and second right longitudinal air chambers 54 and 56 of the assembled right shorts portion 16 are disposed in front of the right thigh 11 on the basis of the wearer 10, and the third and fourth right longitudinal air chambers 58 and 60 are disposed to the rear of the right thigh 11 on the basis of the wearer 10.

In the embodiment, there is provided a state in which zippers are used for coupling between the outermost left longitudinal air chambers 38 and 44 of the developed left shorts portion 14 and coupling between the outermost right longitudinal air chambers 54 and 60 of the developed right shorts portion 16.

A zipper is a fastening device in which zipper teeth are fastened to or separated from each other between a pair of zipper strips and a slider is moved in a longitudinal direction of the zipper strips so that the zipper teeth are engaged or separated for coupling or separation, which is generally used in clothes.

A zipper according to the embodiment has a structure in which a pair of zipper strips is separable without a zipper clamp and is configured so that while a pair of such zipper strips 50 and 52 are coupled along the side end of the first left longitudinal air chamber 38 and the side end of the fourth left longitudinal air chamber 44, zipper teeth of the pair of zipper strips 50 and 52 may be fastened or separated according to movement of the slider.

When the zipper 72 formed on the side end of the first left longitudinal air chamber 38 and the side end of the fourth left longitudinal air chamber 44 is fastened, the left shorts portion 14 is assembled. When the zipper 72 is separated, the assembled left shorts portion 14 is developed and becomes the developed left shorts portion 14.

Likewise, the pair of zipper strips 64 and 66 are coupled along the side end of the first right longitudinal air chamber 54 and the side end of the fourth right longitudinal air chamber 60, respectively, so that the right shorts portion 16 may be assembled or developed according to fastening or separation of the zipper 70.

Also, in order to fasten the left shorts portion 14 and the right shorts portion 16 to each other at the open part, the zipper strips 66 and 68 may be coupled along the open right end of the left shorts portion 14 and the open left end of the right shorts portion 16 and the left shorts portion 14 and the right shorts portion 16 may be coupled or separated by the zipper 74. That is, it is configured that the zipper teeth of the pair of zipper strips 66 and 68 may be fastened or separated according to the movement of the slider while the pair of zipper strips 66 and 68 are coupled with the open right end of the left shorts portion 14 and the open left end of the right shorts portion 16, respectively.

Meanwhile, the shorts-type pneumatic massage apparatus according to the embodiment may include the lateral air chambers 46 and 62 capable of supporting the waist region of the wearer 10. That is, as shown in FIG. 1, the left lateral air chamber 46, which communicates with the third left longitudinal air chamber 42 or the fourth left longitudinal air chamber 44 disposed to the rear of the wearer 10 and extends laterally corresponding a left waist region of the wearer 10, may be formed. Also, as shown in FIG. 2, the right lateral air chamber 62, which communicates with the third right longitudinal air chamber 58 or the fourth right longitudinal air chamber 60 disposed to the rear of the wearer 10 and extends laterally corresponding to a right waist region of the wearer 10, may be formed.

In the embodiment, there is provided a form in which the left lateral air chamber 46 communicates with the third left longitudinal air chamber 42 and is disposed laterally, and the right lateral air chamber 62 communicates with the third right longitudinal air chamber 58 and is disposed laterally. As air is injected into the third left longitudinal air chamber 42 and the third right longitudinal air chamber 58, the air is injected into the left lateral air chamber 46 and the right lateral air chamber 62 which communicate therewith. As the air is injected or discharged into or from the left lateral air chamber 46 and the right lateral air chamber 62, the waist region of the wearer 10 is massaged pneumatically.

The air injection adjustment portion 32, which injects air into or discharges air from the longitudinal air chamber 12, may include a plurality of such air lines 76 connected to the longitudinal air chambers 12 and the air injection unit 30 to which the plurality of air lines 76 are connected and which inject air into or discharge the air from the longitudinal air chambers 12.

Since the plurality of longitudinal air chambers 12 form the shorts-pressurizing portion 17, the plurality of air lines 76 are necessary for separately injecting air into the longitudinal air chambers 12. The plurality of air lines 76 are connected to one air injection unit 30 so that air injection and discharge are controlled.

When the individual air lines 76 separated from each other are connected to the longitudinal air chambers 12, the air lines 76 may become untidy and tangled. Accordingly, a single set 78 or 80 may include several air lines 76 and be coupled with the air injection unit 30. That is, the air line set 78 and 80 including the plurality of air lines 76 coupled so that side ends come into contact with each other in a longitudinal direction may be formed and the air lines 76 of the air line sets 78 and 80 may be coupled with the longitudinal air chambers 12 so as to arrange the plurality of air lines 76 not to be untidy.

FIGS. 5 to 7 illustrate an arrangement state of the air lines 76 according to the embodiment in which four air lines 76 form one air line set 78 or 80 so that the side ends come into contact with each other in the longitudinal direction, and the air line sets 78 and 80 are disposed in the left shorts portion 14 and the right shorts portion 16.

FIG. 5 illustrates the left shorts portion 14 which is developed. The air line set 80 for the left side is introduced into the second left longitudinal air chamber 40 so that two air lines 76 may be coupled with the first left longitudinal air chamber 38 and the second left longitudinal air chamber 40, two other air lines 76 may be coupled with the third left longitudinal air chamber 42 and the fourth left longitudinal air chamber 44 via a bottom of the crotch.

When the shorts-pressurizing portion 17 is assembled, the first left longitudinal air chamber 38 and the second left longitudinal air chamber 40 are disposed on a front surface of the assembled shorts-pressurizing portion 17 and the third left longitudinal air chamber 42 and the fourth left longitudinal air chamber 44 are located on a rear surface of the assembled shorts-pressurizing portion 17. When the developed left shorts portion 14 is assembled while the left air line set 80 is coupled as described above, like the assembled left shorts portion 14 of FIG. 7, the left air line set 80 is introduced into the second left longitudinal air chamber 40 so that two air lines thereof are connected to the first and second left longitudinal air chambers 38 and 40 located in front and two other air lines are coupled with the third and fourth left longitudinal air chambers 42 and 44 to the rear via the side end of the left shorts portion 14.

FIG. 6 illustrates the right shorts portion 16 which is developed. The air line set 78 for the right side is introduced into the second right longitudinal air chamber 56 so that two air lines 76 may be coupled with the first right longitudinal air chamber 54 and the second right longitudinal air chamber 56, and two other air lines 76 may be coupled with the third right longitudinal air chamber 58 and the fourth right longitudinal air chamber 60 via the bottom of the crotch.

When the shorts-pressurizing portion 17 is assembled, the first right longitudinal air chamber 54 and the second right longitudinal air chamber 56 are disposed on the front surface of the assembled shorts-pressurizing portion 17 and the third right longitudinal air chamber 58 and the fourth right longitudinal air chamber 60 are located on the rear surface of the assembled shorts-pressurizing portion 17. When the developed right shorts portion 16 is assembled while the right air line set 78 is coupled as described above, like the assembled right shorts portion 16 of FIG. 7, the right air line set 78 is introduced into the second right longitudinal air chamber 56 so that two air lines thereof are connected to the first and second right longitudinal air chambers 56 and 40 located in front and two other air lines are coupled with the third and fourth right longitudinal air chambers 58 and 60 to the rear via the side end of the right shorts portion 16.

As the air line sets 78 and 80 may be coupled with the shorts-pressurizing portion 17, ends of the air line sets 78 and 80 may be exposed to the shorts-pressurizing portion 17. As shown in FIGS. 8 and 9, the air line cover 36 may be formed on each of the left and right shorts portions 14 and 16 so as not to expose a coupled end of the air line sets 78 and 80.

To inject the same amount of air, the left air line set 80 and the right air line set 78 may be coupled with the main air line set 28 which diverges into both sides.

As shown in FIG. 8, one end of the main air line set 28 may be coupled with the air injection unit 30, and the other end of the main air line set 28 may diverge into two through the divergent hole 34 and be connected to the left air line set 80 and the right air line set 78.

FIG. 8 illustrates a front view of the wearer 10 of the shorts-type pneumatic massage apparatus, and FIG. 9 illustrates a side view of the wearer 10 of the shorts-type pneumatic massage apparatus.

When the wearer 10 wears the shorts-pressurizing portion 17 according to the embodiment in the lower body, the pelvis region and the entirety of the thighs 11 above the knees are covered and the left lateral air chamber 46 and the right lateral air chamber 62 are located on the waist region.

When air is injected through the air injection unit 30, the air is injected into the longitudinal air chambers 12 through the air lines 76 so that the longitudinal air chambers 12 and the lateral air chambers 46 and 62 are expanded and pressurize the thighs 11, the pelvis, the waist region, and the like. When the air is discharged, the longitudinal air chambers 12 and the lateral air chambers 46 and 62 are contracted so that pressure is released. A massage is given to the wearer 10 by repetitively pressurizing and relaxing a body of the wearer 10 using air.

FIG. 10 is a cross-sectional view illustrating a pressurized state of the thighs 11. Here, the four longitudinal air chambers 12, which surround the thighs 11 longitudinally, may provide a great massage effect to many athletes, who use their muscles a great deal, and the like by pressurizing or relaxing overall muscles of the thighs 11.

According to the embodiment of the present invention, a shorts-type pneumatic massage apparatus is formed in a shorts shape so that a pressurizing portion surrounds thighs overall and includes an air chamber into which air is injected and which is formed longitudinally lengthwise in a longitudinal direction of legs so as to evenly apply a pneumatic massage to thigh muscles and to simultaneously apply an appropriate pneumatic massage to a pelvis region.

Although the embodiments of the present invention have been described above, the concept of the present invention is not limited to the embodiment disclosed herein and it should be understood that one of ordinary skill in the art who understands the concept of the present invention may easily provide other embodiments through addition, changes, elimination, and the like of components without departing from the scope of the same concept which will be included in the scope of the concept of the present invention.

What is claimed is:

1. A shorts-shaped pneumatic massage apparatus comprising:

a left chamber body including a plurality of left air chambers configured to surround a left thigh of a wearer;

a right chamber body including a plurality of right air chambers configured to surround a right thigh of the wearer, the right chamber body being coupled with the left chamber body; and an air injection adjustment assembly configured to inject air to or discharge air from the plurality of left and the plurality of right air chambers to allow the plurality of left and the plurality of right air chambers to be inflated or deflated, wherein the plurality of left air chambers include a first, a second, a third, and a fourth left longitudinal air chambers adapted to extend in a longitudinal direction of the wearer's left leg, and the first to fourth left longitudinal air chambers are sequentially connected with each other from left to right, wherein the first and second left longitudinal air chambers are directly connected with each other, the second and third left longitudinal air chambers are directly connected with each other, and the third and fourth left longitudinal air chambers are directly connected with each other, and the plurality of left air chambers further comprise a left lateral air chamber adapted to be arranged in a lateral direction of the wearer's left leg to be directly communicated with the third left longitudinal air chamber, such that the first and the second left longitudinal air chambers are to be disposed on a front side of the left thigh of the wearer, the third and the fourth left longitudinal air chambers are to be disposed on a rear side of the left thigh of the wearer, and the left lateral air chamber is to be disposed on a left waist region of the wearer, wherein the plurality of right air chambers include a first, a second, a third, and a fourth right longitudinal air chambers adapted to extend in a longitudinal direction of the wearer's right leg, and the first to fourth right longitudinal air chambers are sequentially connected with each other from right to left, wherein the first and second right longitudinal air chambers are directly connected with each other, the second and third right longitudinal air chambers are directly connected with each other, and the third and fourth right longitudinal air chambers are directly connected with each other, and the plurality of right air chambers further comprise a right lateral air chamber adapted to be arranged in a lateral direction of the wearer's right leg to be directly communicated with the third right longitudinal air chamber, such that the first and the second right longitudinal air chambers are to be disposed on a front side of the right thigh of the wearer, the third and the fourth right longitudinal air chambers are to be disposed on a rear side of the right thigh of the wearer, and the right lateral air chamber is to be disposed on a right waist region of the wearer, wherein the air injection adjustment assembly comprises a plurality of air lines connected to the plurality of left and the plurality of right air chambers, wherein the plurality of air lines include a first, a second, a third, and a fourth left air lines, and the left chamber body includes a first, a second, a third, and a fourth left air injection holes respectively formed in the first, second, third, and fourth left longitudinal air chambers, wherein the first, second, third, and fourth left air lines are respectively coupled to the first, second, third, and fourth left air injection holes, wherein, in the longitudinal direction, the first left air injection hole formed in the first left longitudinal air chamber is placed lower than the second left air injection hole formed in the second left longitudinal air chamber, the fourth left air injection hole formed in the fourth left longitudinal air chamber is placed lower than the first left air injection hole, and the third left air injection hole formed in the third left longitudinal air chamber is placed lower than the fourth left air injection hole, and wherein the plurality of air lines include a first, a second, a third, and a fourth right air lines, and the right chamber body includes a first, a second, a third, and a fourth right air injection holes respectively formed in the first, second, third, and fourth right longitudinal air chambers, wherein the first, second, third, and fourth right air lines are respectively coupled to the first, second, third, and fourth right air injection holes, and wherein, in the longitudinal direction, the first right air injection hole formed in the first right longitudinal air chamber is placed lower than the second right air injection hole formed in the second right longitudinal air chamber, the fourth right air injection hole formed in the fourth right longitudinal air chamber is placed lower than the first right air injection hole, and the third right air injection hole formed in the third right longitudinal air chamber is placed lower than the fourth right air injection hole.

2. The shorts-shaped pneumatic massage apparatus of claim 1, further comprising one or more suspenders configured to be put on shoulders of the wearer to prevent the apparatus from slipping down.

3. The shorts-shaped pneumatic massage apparatus of claim 1, wherein the left chamber body further includes a left zipper disposed along a left side end of the first left longitudinal air chamber and a right side end of the fourth left longitudinal air chamber so that the left chamber body is to spread out by opening the left zipper, and wherein the right chamber body further includes a right zipper disposed along a right side end of the first right longitudinal air chamber and a left side end of the fourth right longitudinal air chamber so that the right chamber body is to spread out by opening the right zipper.

4. The shorts-shaped pneumatic massage apparatus of claim 1, wherein a central zipper is disposed along an open right end of the left chamber body and an open left end of the right chamber body so that the left chamber body and the right chamber body are to be coupled or separated by the central zipper.

5. The shorts-shaped pneumatic massage apparatus according to claim 1, further comprising an air line cover configured to cover the plurality of air lines.

* * * * *